US009500059B1

(12) United States Patent
Taylor et al.

(10) Patent No.: US 9,500,059 B1
(45) Date of Patent: Nov. 22, 2016

(54) WATER PUMP PIPE CUT-OFF TOOL

(71) Applicants: Geryl W. Taylor, Port Lavaca, TX (US); Dakota W. Taylor, Port Lavaca, TX (US)

(72) Inventors: Geryl W. Taylor, Port Lavaca, TX (US); Dakota W. Taylor, Port Lavaca, TX (US)

( * ) Notice: Subject to any disclaimer, the term of this patent is extended or adjusted under 35 U.S.C. 154(b) by 586 days.

(21) Appl. No.: 14/021,473

(22) Filed: Sep. 9, 2013

Related U.S. Application Data

(60) Provisional application No. 61/743,602, filed on Sep. 7, 2012.

(51) Int. Cl.
*E21B 29/00* (2006.01)

(52) U.S. Cl.
CPC ..... *E21B 29/00* (2013.01); *E21B 29/007* (2013.01)

(58) Field of Classification Search
CPC .... E21B 29/002; E21B 29/007; E21B 29/12; E21B 31/16; E21B 29/00
USPC ..... 30/92, 93, 95; 83/54
See application file for complete search history.

(56) References Cited

U.S. PATENT DOCUMENTS 885,478 A 4/1908 Hollingsworth
1,491,463 A 4/1924 Clulow
1,581,010 A 4/1926 Murray
1,616,024 A 2/1927 Brust, Jr.
1,720,692 A 7/1929 Reynolds et al.
1,732,962 A 10/1929 Brust, Jr.
1,778,968 A 10/1930 Towne
2,067,009 A 1/1937 Hinderliter
2,175,622 A * 10/1939 Ercole ..... E21B 29/007 166/55.6
2,201,434 A 5/1940 Gallagher
2,275,911 A 3/1942 Le Bus
2,290,000 A * 7/1942 Scivally ..... E21B 29/007 166/55.7
2,492,813 A 12/1949 Osmun
2,595,008 A 4/1952 Sill
2,970,859 A 2/1961 Justice
4,146,959 A * 4/1979 Hopper ..... B26D 3/169 30/95
4,157,199 A 6/1979 Klingman
4,801,167 A 1/1989 Driskell
5,054,832 A 10/1991 Davis et al.
5,639,135 A 6/1997 Beeman
5,865,253 A 2/1999 Gamper et al.
5,956,853 A * 9/1999 Watamura ..... B23D 21/06 30/94
5,971,086 A 10/1999 Bee et al.
2011/0290487 A1 * 12/2011 Perschke ..... E21B 29/007 166/298

* cited by examiner

*Primary Examiner* — David Bagnell
*Assistant Examiner* — Abraham Laws
(74) *Attorney, Agent, or Firm* — Robert C. Montgomery; Montgomery Patent & Design LLC

(57) ABSTRACT

A water pump pipe cutoff tool provides a means to cut and retrieve an existing original water pipe from within an existing well in such cases where a faulty submersible pump is trapped within said well. By cutting and removing the original water pipe, a new submersible pump can be installed into the well, thereby avoiding the expense of drilling a new well.

14 Claims, 4 Drawing Sheets

WATER PUMP PIPE CUT-OFF TOOL

RELATED APPLICATIONS

The present invention was first described in and claims the benefit of U.S. Provisional Application No. 61/743,602, filed Sep. 7, 2012, the entire disclosures of which are incorporated herein by reference.

FIELD OF THE INVENTION

The present invention relates to a tool to cut and retrieve a portion of piping within a water well below the ground surface, particularly for replacing a damaged section of piping and/or a submersible pump.

BACKGROUND OF THE INVENTION

Socioeconomic factors are of the upmost importance when considering the impact of technological advancement on the general well being of mankind. Technologies that improve a society's socioeconomic status are often times deemed marvels. Such advancements tend to catapult man into the next paradigm shift. However, because of their impact on society, minor interruptions in the operability of these technologies can result in destitute and deprivation. None is more evident than the technologies that grant us access to water. Technologies that provide access to water have become almost commonplace, and even taken for granted. Yet, when an interruption in access to water occurs, significant effort and resources must be expended to restore access quickly. Much water-accessing technologies comprise of submersible pumps that draw water from subterranean basins and transport it to where it is needed. A well is drilled in the ground and the pump is lowered within where it stays to perform work. If the pump or piping of the system fails, the system is often left abandoned due to the cost and time required to correct it. A new well is then drilled where a new pump is installed. Accordingly, there exists a need for a means by which a new pump and piping can be installed in an existing well without having to drill a new well. The development of the present invention fulfills this need.

Prior art in this field consists of underwater pipe cutting torches and methods for cutting, extracting, and connecting pipe submerged underneath water. These devices and methods do not provide a means to cut and extract a pipe within a well casing, as does the current invention. Such devices and methods are designed without consideration of the compromised workspace of a well leading to a submersed pump. It is an object of this invention to provide a means to easily and cost-effectively sever and extract an original pipe extending from a submersible pump within a well casing. It is a further object of this invention to enable the continued use of the well and well casing after the original pipe has been removed.

The apparatus is provided with a housing that is attached to an extraction pipe. The housing is equipped with a cutting blade that is pivotingly attached to a distal end of the housing. A spring mechanism holds the cutting blade in an inward-bias position. A trigger mechanism actuates the blade into an outward position. After the apparatus is attached to an extraction pipe, a user actuates the trigger and slides the apparatus into a well casing and over an original pipe of the well. The trigger is released to allow the blade to make contact with the original pipe. The extraction pipe, along with the apparatus, is then rotated to allow the blade to cut into the original pipe and sever the original pipe. The original pipe is then removed from the well. The use of the present invention enables a user to replace a submersible pump and piping within an existing well casing without the need to drill a new well.

SUMMARY OF THE INVENTION

The apparatus comprises a cylindrical upper section and conical lower section. The upper section is threaded to enable connection to a threaded extraction pipe. The lower section has an outer diameter to allow insertion into a well casing, but an inner diameter to allow reception of an original water pipe of the well. The upper section is further provided with a slot, through which a cutting blade traverses when actuated. The cutting blade is attached to a spring mechanism so as to allow horizontal rotation of the cutting blade. The spring mechanism biases the blade inwardly so as to ensure that the cutting edge of the cutting blade makes contact with the original water pipe. A trigger mechanism, when actuated, retains the cutting blade in an outward position while the extraction pipe and apparatus are inserted into the well.

The apparatus cuts and retrieves tubing from a water well casing, thereby allowing space for a new pump to be installed into the well. The apparatus is threadingly attached to an end of an extraction pipe. The extraction pipe, along with the attached apparatus, is slid over a damaged pipe within a well. A spring-loaded cutting blade of the apparatus is released via a trigger, thereby allowing the cutting edge of the blade to make contact with the damaged pipe. The extraction pipe, along with the apparatus, is then rotated so that the cutting edge of the cutting blade cuts through the damaged pipe. After the damaged pipe is severed, the cutting blade is positioned to traverse an inner area of the apparatus opening to support the severed pipe within the extraction pipe so that it can be removed from the well. After removal, a new pipe and a new submersible pump are installed above the original submersible pump in a conventional manner.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
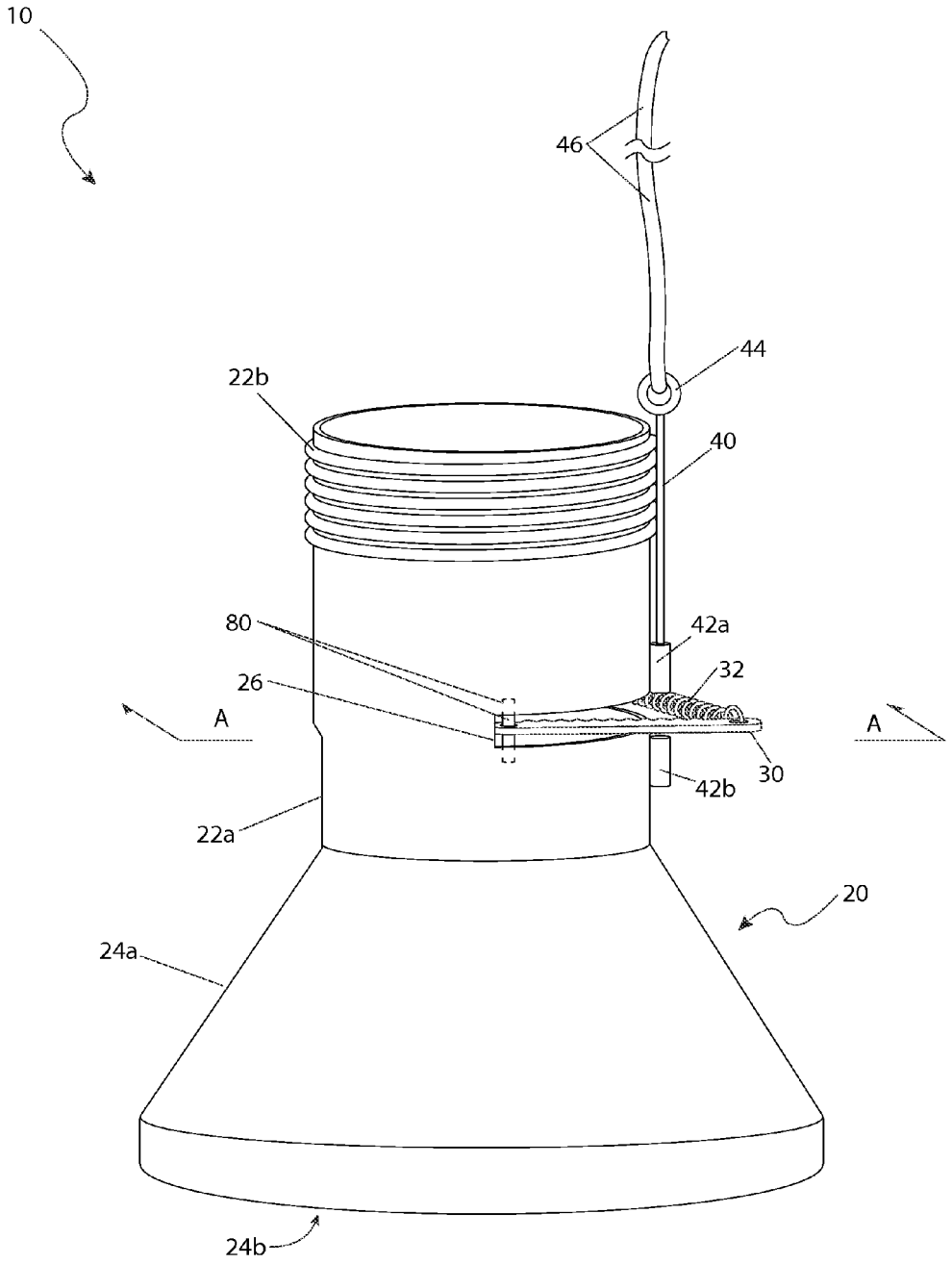
FIG. 1 is a side perspective view of a water pump pipe cut-off tool 10, according to a preferred embodiment of the present invention.

10 water pump pipe cut-off tool
20 body
22*a* upper section
22*b* threaded section

24*a* lower section
24*b* bottom opening
26 cutting blade slot
30 cutting blade
31 tooth
32 spring
36 aperture
40 trigger rod
42*a* first sleeve
42*b* second sleeve
44 first eyelet
46 cord
80 pivot pin
84 second eyelet
86 weld
90 stabilizing device
100 original water pipe
102 well casing
105 extraction pipe

DETAILED DESCRIPTION OF THE PREFERRED EMBODIMENT

The best mode for carrying out the invention is presented in terms of its preferred embodiment, herein depicted within FIGS. 1 through 4 and alternately within FIG. 5. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

The present invention describes a water pump pipe cut-off tool (herein described as the "apparatus") 10, which provides a means to cut and retrieve an existing original water pipe 100 from within an existing well where a faulty submersible pump is trapped within an original well casing portion 102. By cutting and removing the original water pipe 100, a new submersible pump is able to be installed into the well casing 102 above the original submersible pump, thereby avoiding the expense of drilling a new well.

Referring now to FIG. 1, a side perspective view of the apparatus 10, according to a preferred embodiment of the present invention, is disclosed. The apparatus 10 comprises a unitary metal body 20 further comprising a cylindrical upper section 22*a* and a conical or "funnel-shaped" lower section 24*a*. The upper section 22*a* forms a threaded nipple portion 22*b* along an open top portion. The conical lower section 24*a* further comprises a large bottom opening 24*b* having an outer diameter capable of being inserted into the well casing 102 and able to receive the original water pipe 100 within. A cutting blade slot 26 is formed along a side surface of the upper section 22*a* slightly below the threaded nipple portion 22*b* being formed or cut horizontally through approximately one-third (⅓) of the circumference of said upper section 22. The cutting blade slot 26 provides sufficient height to receive and position a spring-loaded cutting blade 30 within, allowing said cutting blade 30 to travel through said cutting blade slot 26 and bear against the original water pipe 100 within the body 20 (see FIGS. 3*a* and 3*b*).

A distal end portion of the cutting blade 30 is attached to a spring 32 while the proximal end is rotatingly attached to the upper section 22*a* via a pivot pin 80, thereby allowing horizontal rotation of said cutting blade 30 in a spring-loaded manner. During the cutting process, the cutting blade 30 is biased inwardly by the spring 32, being motioned through the cutting blade slot 26, and subsequently pressing against the original water pipe 100. The apparatus 10 is then rotated by the user, preferably in a clock-wise direction, to cut through the original water pipe 100. A trigger rod 40 holds the cutting blade 30 in a "ready" position outside the body 20 during insertion of the apparatus 10 into the well casing 102 (see FIGS. 3*a* and 3*b*).

Figure 2:
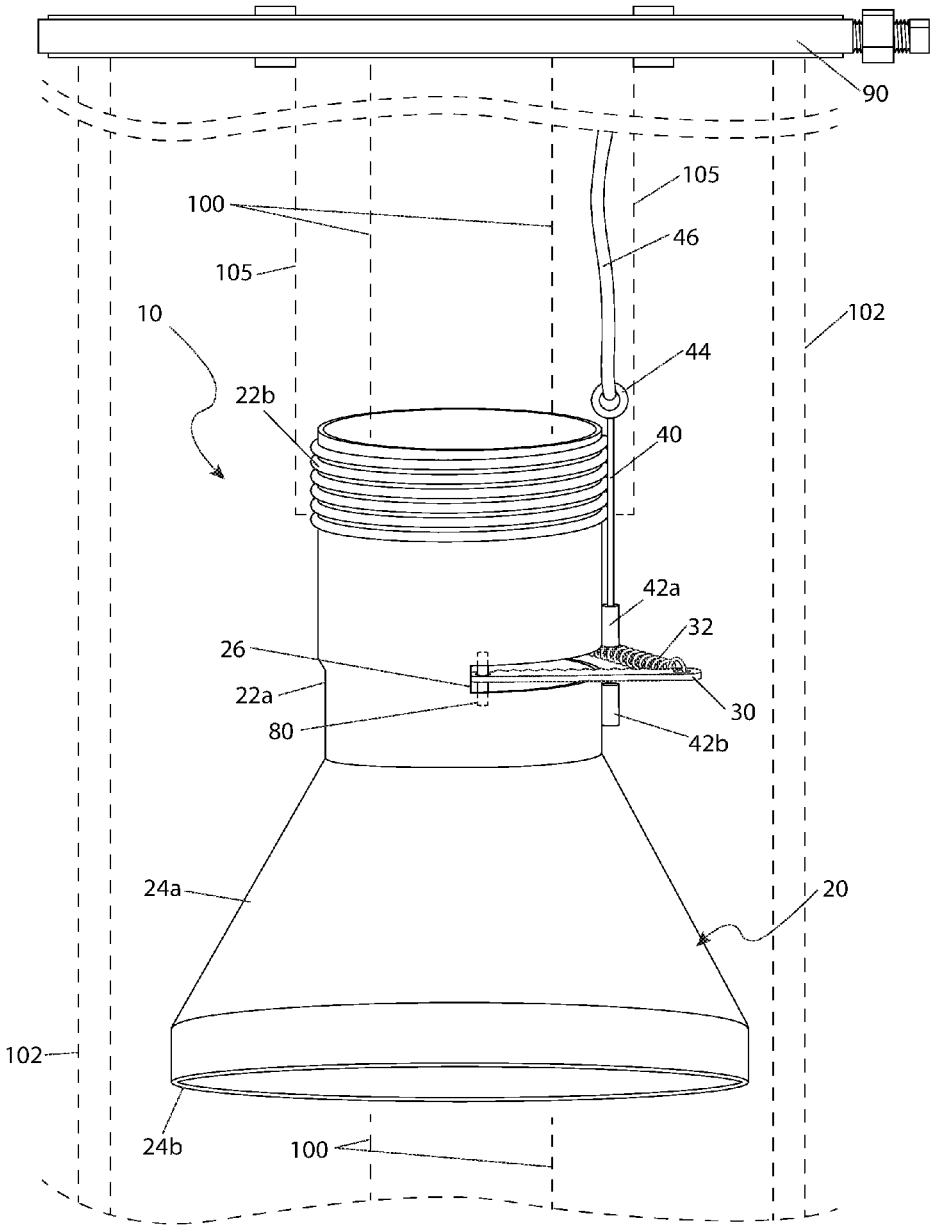
FIG. 2 is an environmental view of the tool 10 depicting an in-use state, according to a preferred embodiment of the present invention.

Referring now to FIG. 2, an environmental view of the apparatus 10 depicting an in-use state, according to a preferred embodiment of the present invention, is disclosed. This apparatus 10 is used to cut and retrieve poly tubing from a water well casing 102 where an original submersible pump is permanently lodged within said well casing 102, thereby allowing space for a new pump to be installed into the well.

In use, the apparatus 10 is threadingly attached to a bottom female-threaded end portion of a larger diameter extraction pipe 105, comprising at least one (1) section of standard polyvinylchloride (PVC) pipe. The apparatus 10 and extraction pipe 105 are slid downwardly over the original water pipe 100 to a point just above the original submersible pump. It is envisioned that a clamp or similar vertically stabilizing device 90 may be installed upon the extraction pipe 105, being installed level with a top surface of the well casing 102 to hold the apparatus 10 at a desired depth. The cutting blade 30 is then released by removing a retaining trigger rod portion 40 to allow the spring-loaded cutting blade 30 to pivot inwardly against the original water pipe 100. The original water pipe 100 is then cut by subsequently rotating the extraction pipe 105 and attached apparatus 10 such that the teeth 31 of the cutting blade 30 cuts the original water pipe 100 (see FIGS. 3*a* and 3*b*). Following the cutting of the original water pipe 100, the cutting blade 30 is positioned so as to support the detached portion of the original water pipe 100 allowing it to be lifted and removed from the well casing 102. With the original water pipe 100 removed, a new submersible pump and new water pipe may be installed above the original submersible pump in a conventional manner, thus saving the well and avoiding the expense of drilling a new well.

The trigger rod 40 is utilized to temporarily position the cutting blade 30 outside the upper section 22*a* to allow the apparatus 10 to slide within the well casing 102 and over the original water pipe 100. The trigger rod 40 is retained in the "ready" position by being inserted into cylindrical, hollow, and vertically aligned first sleeve 42*a* and second sleeve 42*b* portions. The sleeves 42*a*, 42*b* are preferably welded 86 to a side surface of the upper section 22*a*. The first sleeve 42*a* is positioned above the cutting blade slot 26, and the second sleeve 42*b* is positioned below the cutting blade slot 26 (also see FIGS. 3*a* and 3*b*). A top end portion of the trigger rod 40 comprises an integral first eyelet portion 44 through which a cord 46 is tied. The cord 46 extends upwardly out of the well casing 102, thereby allowing a user to pull upon said cord 46 to remove the trigger rod 40 and release the cutting blade 30 to begin a process of cutting the original water pipe 100.

Figure 3A:
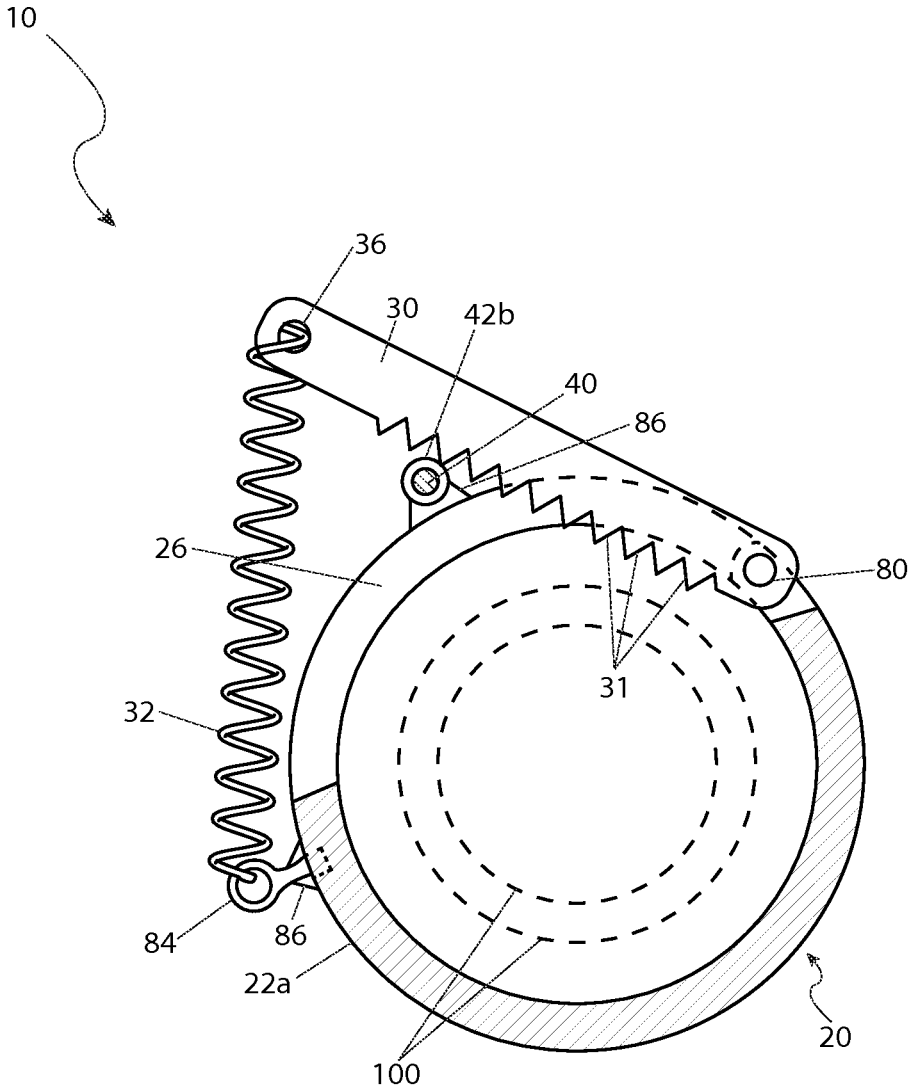
FIG. 3*a* is a sectional view of the tool 10 taken along section line A-A (see FIG. 1), depicting a ready state, according to a preferred embodiment of the present invention; and, FIG. 3*b* is another sectional view of the tool 10 taken along section line A-A (see FIG. 1), depicting a cutting state, according to a preferred embodiment of the present invention.
Figure 3B:
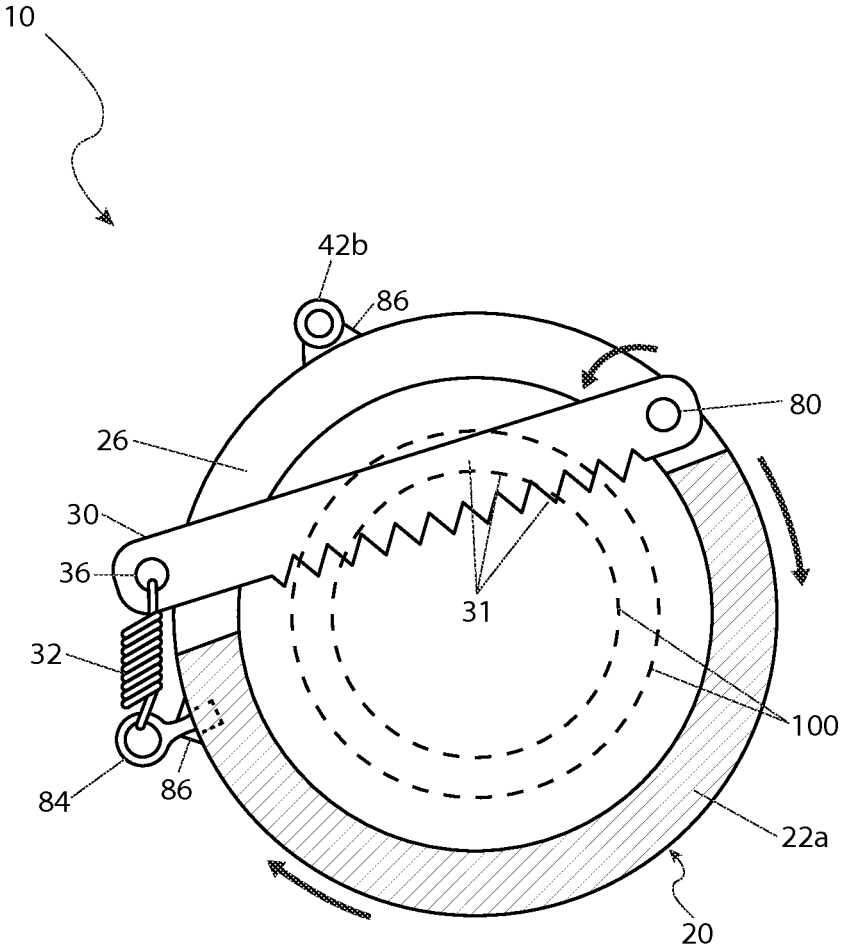

Referring now to FIGS. 3*a* and 3*b*, sectional views of the apparatus 10 taken along section line A-A (see FIG. 1), depicting ready and cutting states, according to a preferred embodiment of the present invention, are disclosed. The apparatus 10 is envisioned to be made using a strong metal material such as steel providing attachment of the cutting blade 30 via the pivot pin 80. The opposite end of the cutting blade 30 comprises an aperture 36 which provides hooking attachment to an end portion of the spring 32. An opposite end portion of said spring 32 is attached to a second eyelet 84 being welded 86 or threadingly attached thereto the upper section 22*a*.

The cutting blade 30 is held in a "ready" position away from the original water pipe 100 by the trigger rod 40 being positioned between the cutting blade 30 and the upper section 22*a* of the body 20. The cutting blade 30 comprises a length of saw blade having cutting teeth 31 along an inwardly-facing edge. Once released by removing the trigger rod 40, the spring 32 acts to motion the cutting blade 30 inwardly through the cutting blade slot 26 and against the original water pipe 100. The extraction pipe 105 and the apparatus 10 are then rotated in a clock-wise direction resulting in a cutting action until the original water pipe 100 is cut through.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIGS. 2, 3*a*, and 3*b*.

The method of installing and utilizing the apparatus 10 may be achieved by performing the following steps: procuring the apparatus 10; pivoting the cutting blade 30 outwardly; securing said cutting blade 30 in place outside the body portion 20 of the apparatus 10 by inserting the trigger rod 40 into the first 42*a* and second 42*b* sleeves; tying the cord 46 to the first eyelet portion 44 of the trigger rod 40; attaching the apparatus 10 threadingly to a bottom end portion of the extraction pipe 105; holding an end portion of the cord 46 while sliding the apparatus 10 and extraction pipe 105 downwardly over the original water pipe 100 pipe until the apparatus 10 rests upon the original submersible pump; raising the tool up approximately six (6) inches to properly position the cutting blade 30 above an original discharge pipe portion of the original submersible pump; installing a clamp or similar device upon the extraction pipe 105, being level with a top surface of the well casing 102 to hold the apparatus 10 at the desired depth; pulling upwardly upon the cord 46 to extract the trigger rod 40 from the sleeves 42*a*, 42*b*, releasing the cutting blade 30 against the original water pipe 100; rotating the extraction pipe 105 and attached apparatus 10 in a clock-wise direction allowing the cutting blade 30 to cut the original water pipe 100 until completely severed; lifting and removing the extraction pipe 105, apparatus 10, and the detached portion of the original water pipe 100 resting upon the cutting blade 30; removing said portions from the well casing 102; installing a new submersible pump and new water pipe above the original submersible pump in a conventional manner; and, benefiting from saving an existing water well afforded a user of the present invention 10.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A pipe severing tool, comprising:

a unitary body, further comprising an upper section having an open top, a fastening means on a perimeter about said open top, and a lower section having a bottom opening;

a cutting blade having a first end pivotally attached to a sidewall of said upper section with a pivot pin and a second end attached to a biasing means attached to said sidewall of said upper section; and, an actuator operably connected to said unitary body;

wherein said fastening means is configured to removably attach said upper section to an extraction pipe;

wherein said bottom opening is configured to receive a pipe within;

wherein said cutting blade travels through a slot located in said sidewall of said upper section to contact said pipe;

wherein said actuator retains said cutting blade from being acted upon by said biasing means;

wherein said biasing means and said pivot pin are disposed on diametrically opposing positions on said upper section;

wherein said biasing means biases a cutting edge of said cutting blade against said pipe when said actuator is removed from said unitary body;

wherein said extraction pipe is operated by a user to direct a cutting action of said cutting blade against said pipe; and, wherein said cutting blade supports a bottom portion of a severed section of said pipe when said tool and said severed section of pipe is extracted.

2. The tool of claim 1, wherein said upper section is generally cylindrical and said lower section is generally conical.

3. The tool of claim 1, wherein said biasing means is a spring.

4. The tool of claim 1, wherein said slot is located subjacent from said open top of said upper section.

5. The tool of claim 1, wherein said slot is formed horizontally through approximately one-third of a circumference of said upper section.

6. The tool of claim 1, wherein actuator further comprises:

a trigger rod retained against said sidewall of said upper section to prevent said biasing means from biasing said cutting edge of said cutting blade from traveling into said slot; and, a cord having a bottom end attached to an upper end of said trigger rod;

wherein said cord is acted upon to remove said trigger rod from said upper surface to enable said biasing means to bias said cutting edge of said cutting blade through said slot.

7. The tool of claim 6, further comprising:

a first sleeve affixed to said sidewall of said upper section positioned above said slot; and, a second sleeve affixed to said sidewall of said upper section positioned below said slot;

wherein said first sleeve and said second sleeve are vertically aligned; and, wherein said trigger rod is removable from both said first and second sleeves.

8. A pipe severing tool, comprising:

a unitary body, further comprising an upper section having an open top, a fastening means on a perimeter about said open top, and a lower section having a bottom opening;

a cutting blade having a first end pivotally attached to a sidewall of said upper section with a pivot pin and a second end attached to a biasing means attached to said sidewall of said upper section;

an extraction pipe removably attached to said fastening means;

a stabilizing device installed upon said extraction pipe to hold said unitary body at a desired depth; and, an actuator operably connected to said unitary body;

wherein said bottom opening is configured to receive a pipe within;

wherein said cutting blade travels through a slot located in said sidewall of said upper section to contact said pipe;

wherein said actuator retains said cutting blade from being acted upon by said biasing means;

wherein said biasing means and said pivot pin are disposed on diametrically opposing positions on said upper section;

wherein said biasing means biases a cutting edge of said cutting blade against said pipe when said actuator is removed from said unitary body;

wherein said extraction pipe is operated by a user to direct a cutting action of said cutting blade against said pipe; and, wherein said cutting blade supports a bottom portion of a severed section of said pipe when said tool and said severed section of pipe is extracted.

9. The tool of claim 8, wherein said upper section is generally cylindrical and said lower section is generally conical.

10. The tool of claim 8, wherein said biasing means is a spring.

11. The tool of claim 8, wherein said slot is located subjacent from said open top of said upper section.

12. The tool of claim 8, wherein said slot is formed horizontally through approximately one-third of a circumference of said upper section.

13. The tool of claim 8, wherein actuator further comprises:

a trigger rod retained against said sidewall of said upper section to prevent said biasing means from biasing said cutting edge of said cutting blade from traveling into said slot; and, a cord having a bottom end attached to an upper end of said trigger rod;

wherein said cord is acted upon to remove said trigger rod from said upper surface to enable said biasing means to bias said cutting edge of said cutting blade through said slot.

14. The tool of claim 13, further comprising:

a first sleeve affixed to said sidewall of said upper section positioned above said slot; and, a second sleeve affixed to said sidewall of said upper section positioned below said slot;

wherein said first sleeve and said second sleeve are vertically aligned; and, wherein said trigger rod is removable from both said first and second sleeves.

* * * * *